US005495322A

United States Patent [19]

Wada et al.

[11] Patent Number: 5,495,322

[45] Date of Patent: Feb. 27, 1996

[54] ELECTROPHOTOGRAPHIC DEVLOPING APPARATUS WHICH UTILIZES SINGLE-COMPONENT DEVELOPING MATERIAL

[75] Inventors: Toshiyuki Wada, Minoo; Kenji Asakura, Katano; Yoshihiro Yokoyama, Takatsuki; Yoshihito Urata, Katano, all of Japan

[73] Assignee: Matsushita Electric Industrial Co., Ltd., Osaka, Japan

[21] Appl. No.: 70,171

[22] Filed: Jun. 2, 1993

[30] Foreign Application Priority Data

Jun. 3, 1992 [JP] Japan ..... 4-142480

[51] Int. Cl.[6] ..... G03G 15/06

[52] U.S. Cl. ..... 355/260; 118/651; 355/246

[58] Field of Search ..... 355/245, 250, 355/251, 253, 259, 260, 246, 254, 255; 118/651, 653, 654, 656, 655, 657, 658, 661

[56] References Cited

U.S. PATENT DOCUMENTS

| | | | |
|---|---|---|---|
| 4,100,884 | 7/1978 | Mochizuki et al. | 118/653 |
| 4,903,634 | 2/1990 | Ono et al. | 118/653 |
| 5,172,168 | 12/1992 | Satoh et al. | 355/245 |
| 5,245,391 | 9/1993 | Suzuki et al. | 118/651 X |
| 5,270,782 | 12/1993 | Floyd, Jr. | 355/245 |
| 5,270,782 | 12/1993 | Floyd, Jr. | 355/245 |
| 5,307,126 | 4/1994 | Kurita | 355/251 |
| 5,324,884 | 6/1994 | Honda et al. | 118/651 |
| 5,333,040 | 7/1994 | Imamiya | 355/245 X |
| 5,339,141 | 8/1994 | Suzuki et al. | 118/651 X |

FOREIGN PATENT DOCUMENTS

| | | | |
|---|---|---|---|
| 4105262 | 8/1991 | Germany . | |
| 56-110963 | 9/1981 | Japan . | |
| 60-114891 | 6/1985 | Japan | 355/259 |
| 61-55670 | 3/1986 | Japan | 355/259 |
| 62-211674 | 9/1987 | Japan . | |
| 63-98676 | 4/1988 | Japan | 355/259 |
| 1-124880 | 5/1989 | Japan | 355/259 |

*Primary Examiner*—A. T. Grimley
*Assistant Examiner*—Shuk Y. Lee
*Attorney, Agent, or Firm*—Wenderoth, Lind & Ponack

[57] ABSTRACT

An electrophotographic developing apparatus includes a photoreceptor drum supported for rotation in one direction, a rotatably supported developing roller disposed in face-to-face relation with the photoreceptor drum for supplying a single-component developing material, a rotatably supported charge transfer roller disposed on one side of the developing roll remote from the photoreceptor drum and in face-to-face relation with the developing roller for delivering the developing material onto the developing roller, a charged layer regulating member disposed around the charge transfer roller and cooperable with the charge transfer roller to regulate a charging and a layer of the developing material, and a developing hopper for accommodating the developing material to be supplied to the charge transfer member. In operation, the developing material within the hopper is carried by the charge transfer roller in the form of a charged toner layer which is subsequently delivered onto the developing roller. The toner layer on the developing layer is then deposited on an electrostatic latent image formed on the photoreceptor drum. At least one of a material for, a surface roughness of and a speed of movement of the developing roller differs from that of the charge transfer roller.

15 Claims, 2 Drawing Sheets

ELECTROPHOTOGRAPHIC DEVLOPING APPARATUS WHICH UTILIZES SINGLE-COMPONENT DEVELOPING MATERIAL

BACKGROUND OF THE INVENTION

1. Field of the Invention

The present invention relates to an electrophotographic developing apparatus of a type employed in an electrophotographic system utilizing a so-called single-component developing material, which apparatus is operable to develop an electrostatic latent image formed on a photosensitive medium into a toner image.

2. Description of the Prior Art

The electrophotographic developing apparatus of the type to which the present invention pertains has come to be largely employed in an electrophotographic copying machine, a laser beam printer, a facsimile machine or the like. A developing method employed in the electrophotographic developing apparatus is well known in the art and is disclosed in, for example, U.S. Pat. No. 4,903,634.

The prior art electrophotographic developing apparatus will now be discussed with reference to FIG. 4 which illustrates, in a schematic side sectional representation, the structure of the prior art developing apparatus.

In FIG. 4, reference numeral 21 represents a photoreceptor drum; reference numeral 22 represents a developing roller disposed in face-to-face relation with the photoreceptor drum 21 for carrying toner which is a developing material; reference numeral 23 represents a supply roller; reference numeral 24 represents a charged layer regulating blade; reference numeral 25 represents a hopper accommodating therein a mass of one-component (i.e. single-component) toner material; reference numeral 26 represents a paddle board; and reference numeral 27 represents a direct current power source.

The prior art developing apparatus of the above described construction operates in the following manner. The toner material within the hopper 25 is delivered by the paddle board 26 onto the supply roller 23 which subsequently delivers the toner material onto the charge transfer roller 22 to form a layer of toner material on the charge transfer roller 22. This toner layer is, during the continued rotation of the charge transfer roller 22 in the direction shown by the arrow, regulated by the charged layer regulating blade 24 to thereby regulate the amount of toner deposited on the charge transfer roller 22 and at the same time to form the toner layer which has been triboelectrically charged. This toner layer is subsequently deposited faithfully on an electrostatic latent image on the photoreceptor drum 21 by the effect of an electric field developed by the direct current power source 27.

A developing process practiced with the use of the one-component toner material is available in two systems; a contact developing system and a non-contact developing system. In the contact developing system, the developing roller 22 is made of rubber material having an elasticity and is held in contact under pressure with the photoreceptor drum 21 through a toner layer. (See the Japanese Laid-open Patent Publications No. 1-310303 and No. 2-1881.) On the other hand, in the non-contact developing system, the developing roller 22 has a toner layer deposited thereon and is spaced a distance from the photoreceptor drum 21 thereby defining a gap between the developing roller 22 and the photoreceptor drum 21. (See the Japanese Laid-open Patent Publication No. 62-89975.)

However, the prior art developing apparatus of the above described construction has the following problems.

In the first place, the developing member is required to have a number of properties and, therefore, the freedom of choice of material is limited. By way of example, those properties include:

(1) Electroconductivity with which charge can be imparted successively to the toner material, (2) An insulating property with which, even though a defect is found on the photoreceptor member, a leak can be prevented by a developing bias, (3) Resistance to friction brought about by the charged layer regulating blade, (4) Surface roughness by which a predetermined amount of toner material and a predetermined amount of toner charge can be available, (5) Charge imparting power by which the toner material can be charged to a required polarity, (6) A high releasing property by which the toner material can readily be released in order to accomplish a faithful deposit of the toner material on a delicate electrostatic latent image, (7) High shape machinability, and (8) High stability of those properties relative to a change in environment.

As discussed above, the developing roller must satisfy those characteristic requirements including the electroconductivity and the insulating property which are in compatible with each other. In order to satisfy all of those properties, there is no way other than to employ material in the vicinity of limits of those properties and it is indeed difficult for a single member such as the developing roller to satisfy all of those conditions.

Specifically, since in the contact development the developing member is held in contact with the latent image carrier, the developing member must necessarily be an elastic member. For this reason, an inexpensive metallic roller excellent in surface roughness, shape machinability, friction resistance, electroconductivity and charge imparting power cannot be employed in a toner charging and layer regulating section. In general, the elastic roller necessary in the contact developing system has a poor toner releasing property. According to an experiment during which polyurethane rubber imparted with an electroconductivity was employed for the developing roller, adherence and embedding of toner to the developing roller occurred. Because of this, a developing toner amount could not be secured, resulting in toner charge amount as a result of a change in surface condition.

In the second place, the amount of toner per unit surface area of the developing roller confronting the photoreceptor drum (hereinafter referred to as a toner amount) and the amount of charge of toner per unit weight (hereinafter referred to as a toner charge amount) cannot be chosen as desired. Where the toner charge amount is small, an image quality such as a resolution will be adversely affected, but when the toner amount is small, an image density will be reduced.

Where the one-component toner material containing no carrier is processed by the blade to form a toner layer and is at the same time charged electrically, a correlation is found between the toner amount and the toner charge amount. The relationship between the toner amount and the toner charge amount on the developing roller when the surface roughness of the developing roller is changed is shown in FIG. 5. A curve shown by the solid line in FIG. 5 is determined by the coefficient of friction and the charge imparting power of material for the toner material and the charge member (developing roller and toner layer regulating blade) attributable to a charge system. When respective material for the developing roller, the toner material and the charge layer regulating blade has been determined and when the surface roughness of the developing roller is changed, the following relationship is established:

if $w1>w2$, then $q1<q2$, wherein q2 (point A) represents the toner charge amount when the toner amount is w2, and q1 (point B) represents the toner charge amount when the toner amount is w1.

Accordingly, in order to concurrently achieve the sufficient toner amount W1 required for the development and the sufficient toner charge amount q2, material excellent in charge imparting power to the toner material is required for each of the various members. However, according to the prior art, it has been difficult to find an ideal material effective to satisfy the relationship between the required toner amount and the required charge amount such as shown by a curve shown by the broken line.

In the case of the contact development, wear of the photoreceptor drum comes to be a problem. Since the toner amount becomes small as discussed above when the toner charge amount is high, an attempt has been made to rotate the developing roller at a higher speed than the photoreceptor drum to secure the toner amount on the photoreceptor drum such as disclosed in, for example, the Japanese Laid-open Patent Publication No. 1-310302. In such case, wear of the photoreceptor drum comes to be a problem. In particular, when the process speed is high, the photoreceptor drum tends to wear rapidly, resulting in a considerably reduced lifetime of the photoreceptor drum.

In the case of the non-contact development, an edge effect in which a relatively large amount of toner deposits at an edge portion of the electrostatic latent image tends to occur when a difference in speed exists between the developing member and the photoreceptor member. For this reason, no difference in speed can be imparted between the developing roller and the photoreceptor drum. Accordingly, it is necessary to secure the toner amount sufficient to accomplish a density on the developing roller. However, when the sufficient toner amount is desired, no sufficient toner charge amount can be satisfied, resulting in an image of low resolution.

SUMMARY OF THE INVENTION

The present invention has as its object to provide an improved electrophotographic developing apparatus effective to provide a relatively large freedom of choice of material for the developing member and in which any combination of the required charge amount and the toner amount is possible.

To this end, the present invention provides an electrophotographic developing apparatus which comprises a latent image carrier supported for movement in one direction, a developing member disposed in face-to-face relation with the latent image carrier for supplying a one-component developing material, a charge transfer member disposed on one side of the developing member remote from the latent image carrier and in face-to-face relation with the developing member for delivering the developing material onto the developing member, a charged layer regulating member disposed around the charge transfer member and cooperable with the charge transfer member to regulate a charging and a layer of the developing material, and a developing hopper for accommodating the developing material to be supplied to the charge transfer member.

In this apparatus, the developing material within the hopper is carried by the charge transfer member in the form of a charged toner layer which is subsequently delivered onto the developing member. The toner layer on the developing layer is then deposited on an electrostatic latent image formed on the latent image carrier.

According to the present invention, at least one of the material for, a surface roughness of and a speed of movement of the developing member differs from that of the charge transfer member.

According to the present invention, a charging and layer forming unit and a developing unit are made up of separate members whereby synthetic resin satisfying only required properties (electroconductivity, charge imparting power, frictional resistance and surface and shape machinability), all necessitated for the electrostatic chargeability, can be used for the charge transfer member while rubber material satisfying only required properties (elasticity, toner releasing property, leak preventive property and shape machinability), all necessitated for the contact development, can be used for the developing member. Because of this, in contrast to the prior art in which the single developing member satisfies all of those properties, the present invention makes it possible to form the separate members, i.e., the charge transfer member and the developing member, with the use of the different resinous materials each satisfying different properties and, therefore, the present invention provides a relatively large freedom of choice of material while providing a reliability relative to a change in environment.

Particularly in the case of the contact developing system, since the developing member and the charge transfer member are separate from each other and what is held in contact with the latent image carrier is the developing member, the charge transfer member can be in the form of an inexpensive rigid metallic roller which is excellent in surface roughness, shape machinability, frictional resistance, electroconductivity and chargeability, with no possibility of the surface of the latent image carrier being impaired.

Also, according to the present invention, the toner amount and the toner charge amount both on the developing member can be suitably chosen as desired by forming a charged toner layer on the charge transfer member and then transferring this toner layer onto the developing member moving at a speed different from that of the charge transfer member.

Specifically, when the charge transfer member has a small surface roughness, the toner layer (the amount w2 of toner per unit of surface area) which has been highly charged can be obtained with a reduced amount of toner. If the velocity (u2) of movement of the surface of the charge transfer member is chosen to be relatively higher than the velocity (u1) of movement of the surface of the developing member and the toner material deposited on the charge transfer member is caused to be transferred onto the developing member, it is possible to form on the developing member the toner layer of a relatively large quantity (the amount w1 of toner per unit of surface area) of toner having been highly charged. Since $w1= w2*(u2/u1)$, the amount of toner on the developing roller can be freely chosen according to the velocity ratio (u2/u1).

Also, when the potential of the charge transfer member and that of the developing member are designated by Vc and Vb, respectively, and when a potential effective to cause the sign of the difference, Vc–Vb, to match with the charge polarity of the toner material is applied, the transfer of the toner material onto the developing member can be facilitated.

As discussed above, even though conditions are employed in which the toner charge amount is high, the difference in velocity of surface movement between the charge transfer member and the developing member can ensure a sufficient toner amount and, therefore, it is not necessary to provide a difference in velocity of surface movement between the latent image carrier and the developing member. For this reason, even in the case of the contact developing system in which the latent image carrier and the developing roller are held in contact with each other, the resultant image exhibiting both a sufficient image density and an image resolution can be obtained without inviting any wear of the surface of the latent image carrier. Similarly, even in the non-contact developing system, no difference is necessary between the velocity of movement of the surface of the developing member and that of the latent image carrier and, therefore, the resultant image exhibiting an improved image density and an improved image resolution can be obtained, having taken the advantage of the non-contact developing system wherein deposit of toner on a non-image area can be prevented without the occurrence of an edge effect.

Again, the provision is made of a member for removing residue toner material on the developing material, which has moved past a nipping region between the developing member and the latent image carrier. The use of the removing member is effective to successively form a stabilized developing toner layer while refreshing the surface of the developing member even through the toner material has been partially consumed for development.

According to a different embodiment of the present invention, the charge transfer member is pressed to the developing member through the toner layer. In this system, the toner material on the developing member can be transferred by applying a voltage between the charge transfer member and the developing member. In such case, even though the amount of toner on the charge transfer roller is excessive, the transfer completes under a condition in which the surface potential resulting from the charge of the transferred toner layer is equalized to the applied potential difference. Accordingly the amount of the toner material transferred is determined according to the toner charge amount and the applied voltage and, accordingly, the toner layer of a required amount can be formed on the developing roller. Therefore, even though no toner removing member is employed for the developing member, notwithstanding a biased consumption of the toner material which tends to occur during the development, the toner layer of the required amount can be reproduced at any location regardless of whether the toner material remains unremoved or whether the toner has been consumed, after it has moved past the nipping region between the developing member and the charge transfer member, thereby accomplishing a satisfactory development under stabilized conditions.

Moreover, when the direction of rotation of the charge transfer member and the developing member held in contact therewith is reversed, the toner material can be deposited while the toner material remaining on the developing member is removed. For this reason, it is possible to form the toner layer of the required amount while refreshing the toner remaining on the developing roller. Accordingly, as compared with the case in which the charge transfer member and the developing member are driven in normal directions conforming to each other, the toner layer of the required amount can be reproduced more favorably at any location regardless of whether the toner material remains unremoved or whether the toner has been consumed, after it has moved past the nipping region between the developing member and the charge transfer member, thereby accomplishing a satisfactory development under stabilized conditions.

As hereinabove described, the developing apparatus of the present invention, while comprising the latent image carrier, the developing member disposed in face-to-face relation with the latent image carrier for supplying a one-component developing material, the charge transfer member disposed on one side of the developing member remote from the latent image carrier and in face-to-face relation with the developing member for delivering the developing material onto the developing member,and the charged layer regulating member disposed around the charge transfer member and cooperable with the charge transfer member to regulate a charging and a layer of the developing material, is operable to transfer the charged toner layer onto the developing member which is subsequently deposited on the latent image carrier to develop the electrostatic latent image into the toner image. With the developing apparatus of the present invention, due to a difference in type of material, roughness and/or velocity of movement of the respective surfaces of the developing member and the charge transfer member, a relatively large freedom of choice of material for the developing member can be appreciated and, also, the charge amount and the toner amount of the toner layer on the developing member can be chosen as desired.

Even in the contact developing system, since the developing member and the charge transfer member are members separate from each other, an inexpensive metallic roller having excellent properties in electroconductivity, charge imparting power, frictional resistance and surface and shape machinability can be employed for the charge transfer member with no possibility of impairing the latent image carrier.

The disposition of the developing member spaced a slight distance from the charge transfer member with a gap intervening therebetween ensures that, even though they are rigid, they will not be impaired, and accordingly both of these members may be made of metal. The formation of the developing member and the charge transfer member using metal makes it possible to accomplish a highly accurate machining of the surface and/or the shape thereof.

Since the toner amount and the charge amount can be sufficiently secured on the developing member, no difference in velocity of surface movement is necessary between the developing member and the latent image carrier. For this reason, even in the contact development in which the developing member is held in contact with the latent image carrier, not only can an undesirable wear of the surface of the latent image carrier be prevented, but also a high speed and an improved lifetime can be realized.

Even in the non-contact developing system, since the toner layer of the sufficient toner amount and the sufficient charge amount can be formed on the developing member, the resultant image exhibiting an improved image density and an improved image resolution can be obtained, having taken advantage of the non-contact developing system wherein deposit of toner on a non-image area can be prevented without the occurrence of an edge effect.

The use of the removing member is effective to successively form a stabilized developing toner layer while refreshing the surface of the developing member even through the toner material has been partially consumed for development.

Also, when the potential of the charge transfer member and that of the developing member are designated by Vc and Vb, respectively, and when a potential effective to cause the sign of the difference, Vc–Vb, to match with the charge polarity of the toner material is applied, the transfer of the toner material onto the developing member can be facilitated.

Since the transfer of the toner material is completed under a condition in which the potential of the toner layer on the developing member is equalized to the applied potential difference when a potential difference is applied between the charge transfer member and the developing member then held in contact with the charge transfer member, it is possible to successively form a stabilized developing toner layer on the developing member.

Moreover, when the direction of rotation of the charge transfer member and the developing member held in contact therewith is reversed, both of the removal of the residue toner from the developing member and the transfer of the toner material on the developing member can be accomplished even though no toner removing member is employed. Also, the application of the voltage to transfer the toner material makes it possible to regulate the amount of toner material transferred with the applied voltage and, therefore, the stabilized developing toner layer can be obtained successively.

Furthermore, the application of an alternating current bias between the developing member and the charge transfer member is effective to reduce any possible coagulation of toner particles to reduce a variation in the toner layer, thereby making it possible to accomplish a development of a high quality image.

BRIEF DESCRIPTION OF THE DRAWINGS

This and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENTS

Preferred embodiments of the present invention will now be described individually with reference to the accompanying drawings.

Figure 1:
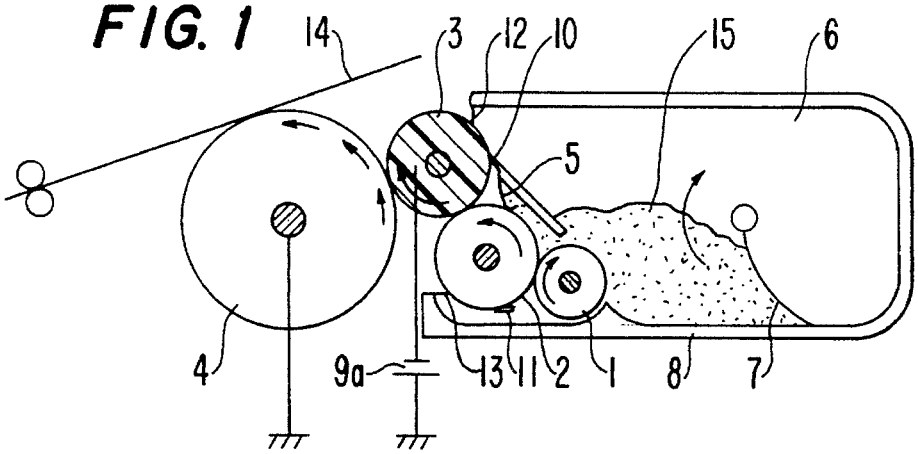
FIGS. 1 to 3 are schematic side sectional views of an electrophotographic developing apparatus according to first to third preferred embodiments of the present invention, respectively.

Referring first to FIG. 1 showing an electrophotographic developing apparatus according to a first preferred embodiment of the present invention, the apparatus shown therein comprises a generally box-like developer housing 8 having a hopper 6 defined therein for accommodating a mass of one component (i.e. single-component type) type non-magnetizable toner material 15 which does not contain carrier beads and which can be charged to a negative polarity. The housing 8 accommodates therein a supply roller 1, a charge transfer roller 2, a developing roller 3 positioned on one side of the charge transfer roller 2 remote from the supply roller 1, a charged layer regulating blade 5, a paddle board 7, a first toner removing member 10 for removing toner deposited on the developing roller 3, a second toner removing member 11 for removing toner deposited on the charge transfer roller 2, a first recovery seal 12 for recovering toner from the developing roller 3 and also for avoiding a fall of toner within the hopper 6, and a second recovery seal 13 for recovering toner from the charge transfer roller 2 and also for avoiding a fall of toner within the hopper 6.

A photoreceptor drum 4 is positioned outside the developer housing 8 and in the vicinity of the developing roller 3 and is supported for rotation in one direction shown by the arrow. Shown as extending over the photoreceptor drum 4 in contact therewith is a recording paper 14.

The supply roller 1 is in the form of a sponge roller and is operable to supply the toner material 15, which has been delivered by the paddle board 7 from the hopper 6, onto the charge transfer roller 2.

The charge transfer roller 2 is of a structure comprising a metal core around which an electroconductive synthetic resin layer is formed and is operable to charge the toner material 15 to a predetermined negative polarity. More specifically, this charge transfer roller 2 comprises an electroconductive layer made of polyurethane or silicone resin having an excellent resistance to friction and mixed with particles or fibers having an electroconductive property and a charge characteristic such that it is capable of being charged to a polarity opposite to that of the toner material. This charge transfer roller 2 has a rough surface, an average surface roughness Ra at a center line thereof being within the range of 1.0 to 2.0 μm, and an electrical resistance which is not so high (about 106 Ω·cm or lower). This charge transfer roller 2 is supported for rotation in one direction shown by the arrow and is held in contact with the developing roller 3 through a layer of toner material.

The developing roller 3 is in the form of a metal core around which an elastic material such as electroconductive rubber is formed and has a surface region made of material having a good release property relative to the toner material and also having a high electrical resistance (107 Ω·cm or higher). More specifically, the elastic material is in the form of polyurethane or silicone rubber mixed with electroconductive particles or fibers (about 104 Ω·cm) and having a surface coated with a layer of Teflon resin of about 50 μm in thickness. This developing roller 3 is also supported for rotation in a direction shown by the arrow and performs a so-called contact development wherein the developing roller 3 is pressed against the photoreceptor drum 4 to deposit the toner material faithfully on an electrostatic latent image by the effect of an electric field developed by a direct current power source 9*a* to create a developing potential.

The photoreceptor drum 4 is driven at a peripheral velocity (a process speed) of 60 mm/sec. The developing roller 3 and the charge transfer roller 2 move past a common nipping region at an equal speed and are driven in respective directions counter to each other at a peripheral velocity which is twice that of the photoreceptor drum 4.

The charged layer regulating blade 5 is made of elastic material and is normally urged toward the charge transfer roller 2. More specifically, this charged layer regulating blade 5 is made of polyurethane, silicone rubber or a thin metallic plate.

The first and second toner removing members 10 and 11 are made of polyurethane rubber, PET, acrylic resin or a thin metallic plate and are urged so as to contact the developing roller 3 and the charge transfer roller 2, respectively.

The electrophotographic developing apparatus of the above described construction functions in the following manner. Assuming that the various elements are driven in respective directions shown by the associated arrows, the toner material 15 within the hopper 6 is delivered by the paddle board 7 onto the supply roller 1 which subsequently delivers the toner material onto the charge transfer roller 2 to form a layer of toner material on the charge transfer roller 2. The toner layer on the charge transfer roller 2 is, during the continued rotation of the charge transfer roller 2 in the direction shown by the arrow, regulated by the charged layer regulating blade 5 to thereby regulate the amount of toner deposited on the charge transfer roller 2 and at the same time to form the toner layer which has been triboelectrically charged. Since the charge transfer roller 2 has the low electrical resistance as discussed hereinbefore and contains material effective to facilitate a charging of the toner material to the predetermined negative polarity, the toner layer having a high electrostatic charge can be successively formed on the charge transfer roller 2. Since the charge transfer roller 2 is held in contact with the developing roller 3, the toner material on the charge transfer roller 2 is delivered onto the developing roller 3 by the effect of a mirror image force of charges retained thereby. An experiment has shown that the amount of toner delivered onto the developing roller was 0.7 mg/cm$^2$ and the amount of charge was 12 μC/g. Utilizing an electric field developed by the application of the developing direct current power source 9*a*, the toner layer on the developing roller 3 is subsequently deposited on an electrostatic latent image carried by the photoreceptor drum 4 to thereby form a powder image. This powder image is subsequently transferred from the photoreceptor drum 4 onto the recording paper 14 to thereby complete the making of a copy.

Although depending on the pattern having been developed, a variation of the toner layer on the developing roller 3 occurs according to a portion in which the toner material has been consumed and a portion in which the toner material remains, the residue toner material on the developing roller 3 is removed by the first toner removing member 10 thereby refreshing the developing roller 3. Then, the toner material is transferred uniformly again from the charge transfer roller 2 onto the developing roller 3, thereby repeating the development.

As hereinabove described, according to the present invention, a charging and layer forming unit and a developing unit are made up of separate members whereby synthetic resin providing only the characteristics of electroconductivity, charge imparting power, frictional resistance and surface and shape machinability, all necessitated for the electrostatic chargeability, can be used for the charge transfer roller 2 while rubber material providing only the characteristics of elasticity, toner releasing property, leak preventive property and shape machinability, all necessitated for the contact development, can be used for the developing roller 3. Because of this, in contrast to the prior art in which the single developing member satisfies all of those properties, the present invention makes it possible to form the separate members, i.e., the charge transfer roller 2 and the developing roller 3, with the use of the different resinous materials each satisfying different properties and, therefore, the present invention provides a relatively large freedom of choice of material while providing a reliability upon to a change in environment.

Results of an experiment conducted have shown that the amount of toner necessary to provide a sufficient density was 1.2 mg/cm$^2$. Since the developing roller 3 is driven at a peripheral velocity which is twice that of the photoreceptor drum 4, the electrostatic latent image on the photoreceptor drum 4 can be developed into the powder image with the toner material in an amount twice the amount (0.7 mg/cm$^2$) of the toner material carried by the developing roller 3, resulting in a reproduction of an image of a sufficient density. Also, since the surface of the developing roller 3 exhibits a good toner releasing property, the toner material can be deposited on the fine electrostatic latent image, resulting in a reproduction of an image exhibiting both a high resolution, which is an important feature of the contact development system, and a high density.

Since the charge transfer roller 2 and the developing roller 3 are pressed so as to contact with each other, the toner material can be transferred onto the developing roller 3 by the effect of the mirror image force of charges retained thereby.

Since the residue toner material remaining on the developing roller 3 is removed by the first toner removing member 10, the toner layer of uniform thickness can be formed on the developing roller 3 without being adversely affected by a variation in toner resulting from the developing pattern.

Where the charge transfer roller 2 and the developing roller 3 held in contact therewith are driven in respective directions counter to those shown by the arrows, it is possible to deposit the toner material while the toner material deposited on the developing roller 3 is removed. Because of this, it is possible to form the toner layer of a uniform quantity on the developing roller 3 while the toner on the developing roller 3 is refreshed. Accordingly, even though a biased consumption of the toner material on the developing roller 3 occurs during the development, the toner layer of a predetermined quantity can be reproduced on the developing roller 3 even after the latter has moved past the nipping region with the charge transfer roller 2, making it possible to accomplish the development under a stabilized condition with no need to employ the first toner removing member 10.

In such case, however, it is necessary to change the respective positions of the charged layer regulating blade 5, the second toner removing member 11 and the first and second recovery seals 12 and 13 depending on the direction of rotation of any one of the charge transfer roller 2 and the developing roller 3.

Figure 2:
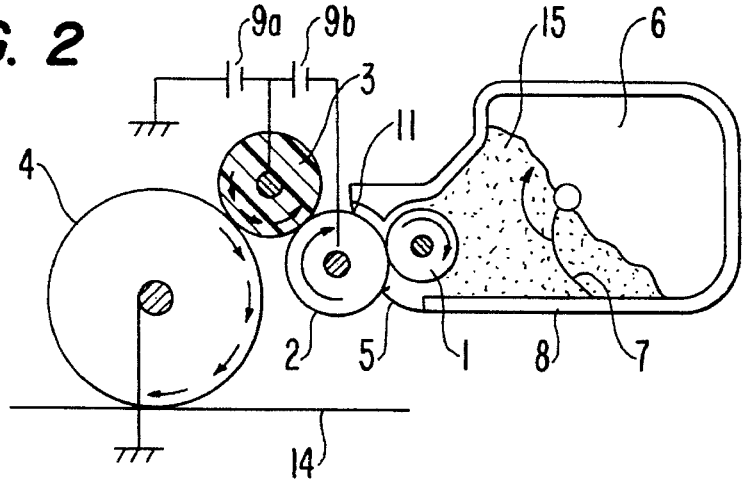

The electrophotographic developing apparatus according to a second preferred embodiment of the present invention will now be described with particular reference to FIG. 2. The structure shown in FIG. 2 differs from that shown in FIG. 1 in the following manner. The charge transfer roller 2 is driven at a peripheral velocity which is three times that of the developing roller 3; the developing roller 3 is driven at a peripheral velocity substantially equal to that of the photoreceptor drum 4; and the photoreceptor drum 4 is driven at a peripheral velocity (process speed) of 120 mm/sec. There is employed a direct current power source 9*b* for a transfer potential which applies a potential effective to permit a potential difference (Vc− Vb, wherein Vc represents the potential of a charge transfer member and Vb represents the potential of a developing member) to match with the polarity to which the toner material is charged. The potential difference satisfies a condition of $|Vt| \leqq |Vc-Vb| \leqq |Vt|+100$ V, wherein Vt represents the surface potential attributable to the amount of charge of the toner layer of a predetermined quantity. The charge transfer roller 2 is employed in the form of a metallic roller. The average surface roughness Ra at the center line of the charge transfer roller 2 is with in the range of 0.2 to 1.0 μm. The charged layer regulating blade 5 held in contact with the charge transfer roller 2 is positioned below the charge transfer roller 2; and the first recovery seal 12 for recovering the toner material from the charge transfer roller 2 is positioned above the charge transfer roller 2.

The voltage of the direct current power source **9*b* for the transfer potential which applies the potential difference between the charge transfer roller 2 and the developing roller 3 will now be described in detail. Assuming that the amount of charge of the predetermined toner layer effective to provide a high resolution and a density is 20 μC/g and the amount of toner is 1.2 mg/cm$^2$, the surface potential of this toner layer will become −350 V. In such case, in accordance with $|Vt| \leqq |Vc-Vb| \leqq |Vt| + 100$ V, the voltage of the direct current power source 9*b*** is suitably chosen to be −400 V. In this way, the voltage to be applied is determined in dependence on the amount of charge of the predetermined toner layer and the amount of toner forming the toner layer.

Figure 5:
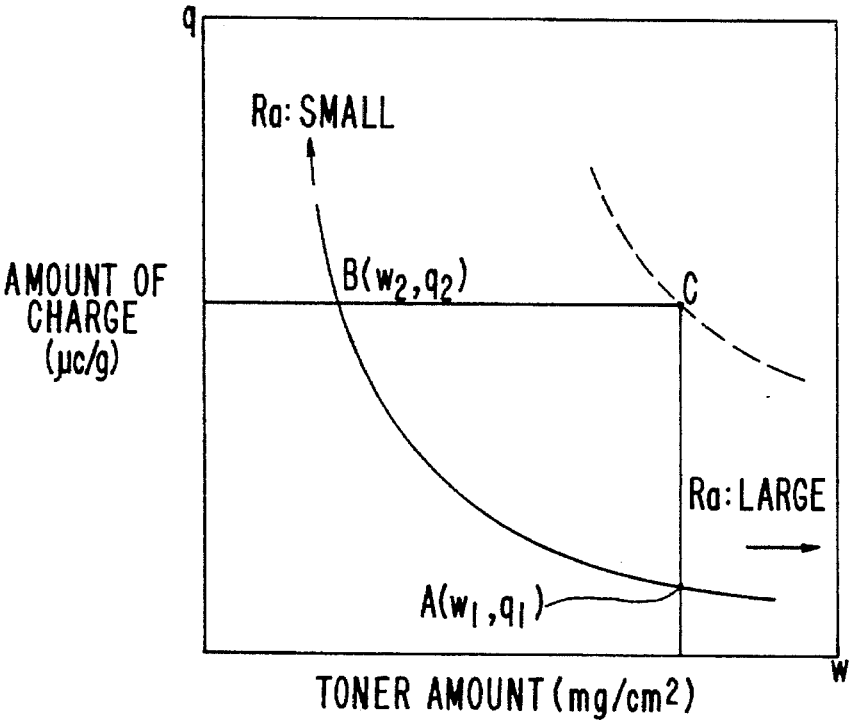
FIG. 5 is a graph showing a relationship between the amount of electrostatic charge and the amount of toner.

The electrophotographic developing apparatus according to the second embodiment of the present invention operates in the following manner. Assuming that the various elements are driven in respective directions shown by the associated arrows, the toner material 15 within the hopper 6 is delivered by the paddle board 7 onto the supply roller 1 which subsequently delivers the toner material onto the charge transfer roller 2 to form a layer of toner material on the charge transfer roller 2. This toner layer is, during the continued rotation of the charge transfer roller 2 in the direction shown by the arrow, regulated by the charged layer regulating blade 5 to thereby regulate the amount of toner deposited on the charge transfer roller 2 and at the same time to form the toner layer which has been triboelectrically charged. As can be readily understood from the graph shown in FIG. 5 and illustrating the relationship between the toner amount, the charge amount and the surface roughness, since the charge transfer roller 2 has a small surface roughness, the highly charged toner layer can be obtained and, on the other hand, no necessary toner amount can be secured. According to results of an experiment conducted, the amount of charge obtained was 20 μC/g, but the toner amount was small at 0.045 mg/cm$^2$ (point B in the graph of FIG. 5). This toner material on the charge transfer roller 2 is then delivered by the effect of an electric field onto the developing roller 3 then driven at a peripheral velocity which is one third of that of the charge transfer roller 2. At this time, the toner material in an amount of 1.35 mg/cm$^2$, which is greater than the necessary toner amount of 1.2 mg/cm$^2$, is deposited on the developing roller 3 to form the toner layer having been highly charged (point C in the graph of FIG. 5). This toner layer is subsequently deposited faithfully on an electrostatic latent image on the photoreceptor drum 4 by the effect of an electric field developed by the direct current power source **9*a***.

As hereinabove described, according to the second preferred embodiment of the present invention, it is possible to obtain on the charge transfer member the toner layer having a high charge amount and a reduced toner amount (toner amount w2 per unit of surface area) and, by choosing the speed of movement (u2) of a surface of the charge transfer member to he relatively higher than the speed of movement (u1) of a surface of the developing member, the toner layer (toner amount w1 per unit of surface area) having a high charge amount and a large toner amount can be realized on the developing member. Since in general w1= w2*(u2/u1), the amount of toner on the developing roller 3 can be chosen as desired in dependence on the peripheral velocity ratio (u2/u1).

Accordingly, at a charged layer regulating region between the charged layer regulating blade 5 and the charge transfer roller 2, it suffices to obtain a predetermined charge amount. Since on the developing roller 3 the toner amount and the charge amount coexist, an image of high resolution, which is an important feature of the contact developing system, and of a sufficient density can be obtained.

Since respective portions of the photoreceptor drum 4 and the developing roller 3 move at an equal speed at the nipping region therebetween, no friction occurs on the surface of the photoreceptor drum 4. Accordingly, the lifetime of the photoreceptor drum 4 can be increased while the contact development is carried out at a high process speed. It has been found that, when the ratio between the speed of movement of that portion of the photoreceptor drum 4 and the speed of movement of that portion of the developing roll 3 at the nipping region was chosen to be within the range of 0.8:1 to 1:0.8, friction of the surface of the photoreceptor drum while the process speed was 120 mm/sec. did not adversely affect the resultant image. It is, however, to be noted that when the speed ratio is 1:1, the amount of toner material developed onto the photoreceptor drum 4 decreases and, therefore, a slight speed difference is to be realized.

By applying the potential of a polarity sufficient to permit the sign of the difference (Vc−Vb) wherein Vc and Vb represent the potential of the developing roller 3 and the potential of the charge transfer roller 2, respectively, to match with the charged polarity of the toner material, a transfer of the toner material onto the developing roller 3 can be facilitated.

Moreover, by applying the voltage between the charge transfer roller 2 and the developing roller 3 while both are pressed close towards each other through the toner layer, the toner material is transferred onto the developing roller 3. When the electric field resulting from charges of the toner layer so transferred becomes equal to the applied electric field, the transfer of the toner material terminates. It is however to be noted that, due to influences brought about by non-electric forces such as a van der Waals force, a somewhat high electric field is required. A result of an experiment has shown that the potential corresponding to the nonelectric force suffices to be 100 V or lower. Accordingly, if the potential difference satisfying the formula ($|Vt| \leqq |Vc-Vb| \leqq |Vt| + 100$ V, wherein Vt represents the surface potential of the toner layer of a quantity required for the development) is applied, the required toner layer can be realized at all times after the developing roller 3, even though a bias occurs in consumption of the toner material on the developing roller 3, has moved past the nipping region with the charge transfer roller 2, thereby making it possible to successively develop under a stabilized condition.

When the developing roller 3 and the charge transfer roller 2 are driven in the respective directions as shown by the arrows, any possible aging resulting from wear of the surface of the elastic roller can be avoided while accomplishing the required toner amount and the charge amount, as compared with the case in which they are driven in respective directions counter to those shown by the arrows.

Also, when the charge transfer roller 2 is made of metal, as compared with rubber or synthetic resin, it is easy to machine the charge transfer roller 2 so as to have an average surface roughness Ra at the center line which is within the range of 0.1 to 1.0 μm and, in addition, any of the electroconductivity, the charge imparting power, the resistance to friction and the surface and shape machinability can easily be improved.

Where the charge transfer roller 2 and the developing roller 3 are driven so that of portion of the charge transfer roller 2 and so that the portion of the developing roller 2 adjacent the nipping region move in respective directions counter to each other, the toner material can be transferred while the residue toner on the developing roller 2 is removed and, therefore, the further stabilized toner layer can be formed as compared with the case in which they are driven so as to cause those respective portions of the rollers 2 and 3 adjacent the nipping region to move in respective directions conforming to each other.

Figure 3:
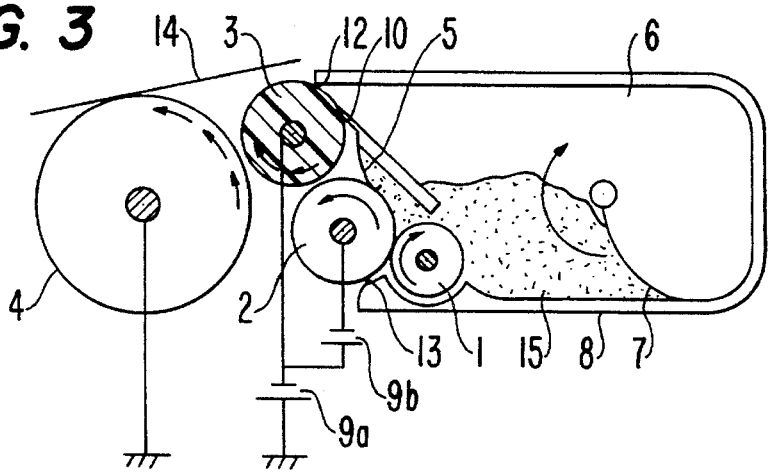
Figure 4:
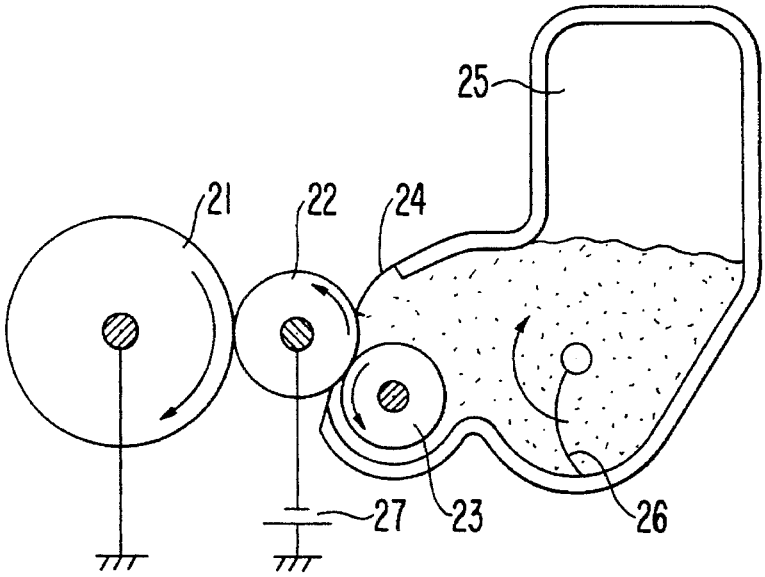
FIG. 4 (PRIOR ART)
FIG. 4 is a schematic side sectional view of the prior art electrophotographic developing apparatus.

Hereinafter, a third preferred embodiment of the present invention will be described with reference to FIG. 3 which illustrates the structure of the developing apparatus according to the third embodiment of the present invention. The structure shown in FIG. 3 differs from that shown in FIG. 2 in the following manner. A gap is formed between the charge transfer roller 2 and the developing roller 3. Both of the charge transfer roller 2 and the developing roller 3 are made of metal. A so-called non-contact developing system is employed in which a gap is provided between the toner layer on the developing roller 3 and the outer peripheral surface of the photoreceptor drum 4. The potential difference applied by the developing direct current power source *9a* is chosen to be −800 V, and the potential difference applied by the transfer potential direct current power source *9b* is chosen to be −550 V.

As is the case with the second embodiment of the present invention, in the practice of the third embodiment of the present invention, the charge transfer roller 2 has a surface roughness within the range of 0.2 to 1.0 μm; a difference is provided between the respective peripheral velocities of the charge transfer roller 2 and the developing roller 3; and the potential required to permit the sign of the difference Vc−Vb (wherein Vc and Vb represent the potential of the charge transfer member and the developing member, respectively) to match with the charged polarity of the toner material is applied.

The operation of the developing apparatus according to the third embodiment of the present invention is as follows. Assuming that the various elements are driven in respective directions shown by the associated arrows, the toner material 15 within the hopper 6 is delivered by the paddle board 7 onto the supply roller 1 which subsequently delivers the toner material onto the charge transfer roller 2 to form a layer of toner material on the charge transfer roller 2. This toner layer is, during the continued rotation of the charge transfer roller 2 in the direction shown by the arrow, regulated by the charged layer regulating blade 5 to thereby regulate the amount of toner deposited on the charge transfer roller 2 and at the same time to form the toner layer which has been triboelectrically charged. Since the charge transfer roller 2 has a small surface roughness, i.e., an average surface roughness Ra at the center thereof being 0.3 μm, the highly charged toner layer can be obtained with a minimized amount of toner. This toner material on the charge transfer roller 2 is then expelled by the effect of an electric field, created by the direct current power source *9b*, onto the developing roller 3 then driven at a peripheral velocity which is one third of that of the charge transfer roller 2. Since the gap intervenes between the charge transfer roller 2 and the developing roller 3, the potential difference of $|Vc-Vb| \geqq |Vt|+200$ V, wherein Vt represents the surface potential of the toner layer of a quantity required for the toner material to be expelled, Vb represents the potential of the developing roller 3 and Vc represents the potential of the charge transfer roller 2, is required. Accordingly, when the surface potential of the predetermined toner layer is chosen to be −350 V, the potential difference given by the direct current power source *9b* suffices to be 550 V or higher. Even though the voltage (−550 V) of the direct current power source *9b* is lower than the voltage (−800 V) of the direct current power source *9a* since a solid development is carried out, the toner material deposited on the charge transfer roller 2 can easily be transferred onto the developing roller 3. This toner layer is subsequently deposited faithfully on an electrostatic latent image on the photoreceptor drum 4 by the effect of an electric field developed by the direct current power source *9a*.

As hereinabove described, according to the second preferred embodiment of the present invention, the presence of the gap between the charge transfer roller 2 and the developing roller 3 permits both of these rollers 2 and 3 to be made of metal so that an aging of the roller surface resulting from wear can be avoided to secure a stabilized performance. Also, the use of the rollers 2 and 3 made of metal improves a toner release property, a surface machinability and a dimensional accuracy.

The presence of the difference in peripheral velocity between the charge transfer roller 2 and the developing roller 3 provides a freedom to choose the toner amount and the charge amount as desired and, therefore, without adversely affecting the developing toner amount and the image resolution, the developing roller 3 and the photoreceptor drum 4 can be driven at a substantially equal speed. When the ratio between the peripheral velocity of the photoreceptor drum 4 and the peripheral velocity of the developing roll 3 at the nipping region is chosen to be within the range of 1:0.8 to 1:1, an edge effect in which a large amount of toner tends to be deposited at a portion corresponding to an edge of an image can advantageously be prevented. Accordingly, the resultant image satisfying the feature of the non-contact developing system which is effective to avoid an occurrence of fogging, i.e., deposition of toner on a non-image area of the photoreceptor drum, and both of the density and the resolution can be obtained.

Also, as is the case with the second embodiment of the present invention, expelling of toner particles between the charge transfer roller 2 and the developing roller 3 can be facilitated by applying a voltage between these rollers.

It is to be noted that, although the charge transfer roller 2 and the developing roller 3 in the third embodiment of the present invention have been described as driven so as to rotate in respective directions conforming to each other, they may be driven so as to rotate in respective directions counter to each other.

Although the present invention has been described in connection with the preferred embodiments thereof with reference to the accompanying drawings, it is to be noted that various changes and modifications will be apparent to those skilled in the art. By way of example, although in the first to third embodiments of the present invention a charged layer regulating member has been described as employed in the form of a blade, it may be in the form of a roller. Similarly, while in the first to third embodiments of the present invention the developing member has been described as employed in the form of a roller, it may be in the form of an endless belt.

A supply member may be employed in the form of a metallic roller although it has been described as employed in the form of a sponge roller.

Instead of the use of the non-magnetizable one-component toner material, magnetizable toner material may equally be employed and, in such case, the charge transfer roller 2 should have a magnet built therein to provide a magnetizable roller. Since the toner material can be supplied onto the charge transfer roller 2 by the effect of a magnetic force by employing the magnetizable toner material and imparting a magnetism to the charge transfer roller 2, the use of the supply roller 1 can be dispensed with. Accordingly, with a simplified structure, the above described effects can be obtained.

Although the toner material has been described as charged to a negative polarity, toner material capable of being charged to a positive polarity may be employed. In such case, the potential difference between the charge transfer roller and the developing roller and the potential difference between the developing roller and the photoreceptor drum must be of a reverse polarity. In addition, material for the charge transfer roller must be changed to material capable of being charged to a positive polarity in the electrostatic charge system.

Finally, while in the second embodiment of the present invention the developing member has been shown as held in contact with the charge transfer member, it may be spaced therefrom such as shown in the third embodiment of the present invention.

Such changes and modifications are to be understood as included within the scope of the present invention as defined by the appended claims, unless they depart therefrom.

What is claimed is:

1. An electrophotographic developing apparatus which comprises:

a latent image carrier;

a developing member disposed in face-to-face relation with the latent image carrier for carrying and transporting a single-component developing material containing no carrier;

a charge transfer member disposed in face-to-face relation with the developing member for carrying and transferring the developing material;

a charged layer regulating member disposed around the charge transfer member and cooperable with the charge transfer member to regulate an amount of the developing material on the charge transfer member;

a developing hopper for accommodating the developing material to be supplied to the charge transfer member; and wherein at least one of a material for and a surface roughness of the charge transfer member is different from that of the developing member.

2. An electrophotographic developing apparatus which comprises:

a latent image carrier;

a developing member disposed in face-to-face relation with the latent image carrier for carrying and transporting a single-component developing material containing no carrier;

a charge transfer member disposed in face-to-face relation with the developing member for carrying and transferring the developing material;

a charged layer regulating member disposed around the charge transfer member and cooperable with the charge transfer member to regulate an amount of the developing material on the charge transfer member;

a developing hopper for accommodating the developing material to be supplied to the charge transfer member; and wherein the charge transfer member and the developing member are operable to rotate such that there exists a difference in speed between a surface of the charge transfer member and a surface of the developing member at a nipping region between the charge transfer member and the developing member.

3. The electrophotographic developing apparatus as claimed in claim 1, wherein there exists a potential difference permitting a sign of Vc–Vb to match with the charged polarity of the developing material at a region where the charge transfer member and the developing member confront with each other, wherein Vc and Vb represent the potential of the charge transfer member and the potential of the developing member, respectively.

4. The electrophotographic developing apparatus as claimed in claim 3, wherein the developing member and the charge transfer member are spaced a slight distance from each other to define a gap therebetween.

5. An electrophotographic developing apparatus which comprises:

a latent image carrier;

a developing member disposed in face-to-face relation with the latent image carrier for carrying and transporting a single-component developing material containing no carrier;

a charge transfer member disposed in face-to-face relation with the developing member for carrying and transferring the developing material;

a charged layer regulating member disposed around the charge transfer member and cooperable with the charge transfer member to regulate an amount of the developing material on the charge transfer member;

a developing hopper for accommodating the developing material to be supplied to the charge transfer member; and wherein at least a surface of the developing member is a resinous material having an elasticity, and wherein the developing material on the developing member is held in face-to-face relation with the latent image carrier while contacting the latent image carrier or the latent image carrier and the developing member are held in face-to-face relation while contacting with each other.

6. The electrophotographic developing apparatus as claimed in claim 1, wherein at least one of a first removing member for removing the developing material on the developing member is positioned downstream of a region at which it confronts the latent image carrier, and a second removing member for removing the developing material on the charge transfer member is positioned downstream of a region at which it confronts the developing member.

7. An electrophotographic developing apparatus which comprises:

a latent image carrier;

a developing member disposed in face-to-face relation with the latent image carrier for carrying and transporting a single-component developing material containing no carrier;

a charge transfer member disposed in face-to-face relation with the developing member for carrying and transferring the developing material;

a charged layer regulating member disposed around the charge transfer member and cooperable with the charge transfer member to regulate an amount of the developing material on the charge transfer member;

a developing hopper for accommodating the developing material to be supplied to the charge transfer member; and wherein at least a surface of the charge transfer member is metal.

8. The electrophotographic developing apparatus as claimed in claim 5, wherein the latent image carrier and the developing member are operable to rotate such that a ratio in peripheral velocity between the latent image carrier and the developing member at a nipping region therebetween is within the range of 0.8:1 to 1:0.8.

9. The electrophotographic developing apparatus as claimed in claim 2, wherein the charge transfer member and the developing member are operable to rotate such that respective directions of movement of associated surfaces of the charge transfer member and the developing member at a region at which they confront with each other are counter to each other.

10. The electrophotographic developing apparatus as claimed in claim 2, wherein the charge transfer member and the developing member are operable to rotate such that respective directions of movement of associated surfaces of the charge transfer member and the developing member at a region at which they confront with each other are the same.

11. The electrophotographic developing apparatus as claimed in claim 2, which satisfies the following formula:

$$u2/u1 \geqq w1/w2,$$

wherein w1 represents an amount of developing material per unitary surface area of a surface of the developing member, u1 represents a velocity of surface movement of the developing member, w2 represents an amount of toner material per unit surface area of a surface of the charge transfer member, and u2 represents a velocity of surface movement of the charge transfer member.

12. The electrophotographic developing apparatus as claimed in claim 1, wherein an alternating current bias is applied between the developing member and the charge transfer member.

13. An electrophotographic developing apparatus which comprises:

a latent image carrier;

a developing member disposed in face-to-face relation with the latent image carrier for carrying and transporting a single-component developing material containing no carrier;

a charge transfer member disposed in face-to-face relation with the developing member for carrying and transferring the developing material;

a charged layer regulating member disposed around the charge transfer member and cooperable with the charge transfer member to regulate an amount of the developing material on the charge transfer member;

a developing hopper for accommodating the developing material to be supplied to the charge transfer member; and wherein the latent image carrier confronts the developing member with a gap formed between the latent image carrier and the developing material on the developing member; and wherein the latent image carrier and the developing member are operable to rotate such that a ratio in peripheral velocity between the latent image carrier and the developing member at a nipping region therebetween is within the range of 0.8:1 to 1:0.8.

14. The electrophotographic developing apparatus as claimed in claim 3, wherein the charge transfer member and the developing member are operable to rotate such that respective directions of movement of associated surfaces of the charge transfer member and the developing member at a region at which they confront with each other are counter to each other.

15. The electrophotographic developing apparatus as claimed in claim 3, wherein the charge transfer member and the developing member are operable to rotate such that respective directions of movement of associated surfaces of the charge transfer member and the developing member at a region at which they confront with each other are the same.

* * * * *